US010329049B2

(12) United States Patent
Learn et al.

(10) Patent No.: US 10,329,049 B2
(45) Date of Patent: Jun. 25, 2019

(54) CONTAINER WITH INNER DIVIDER

(71) Applicant: PACTIV LLC, Lake Forest, IL (US)

(72) Inventors: Angela E. Learn, Gilbertsville, PA (US); Darin Guido McKnight, II, Stoughton, WI (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 15/347,192

(22) Filed: Nov. 9, 2016

(65) Prior Publication Data

US 2017/0057689 A1 Mar. 2, 2017

Related U.S. Application Data

(63) Continuation of application No. PCT/US2015/031775, filed on May 20, 2015.

(60) Provisional application No. 62/000,704, filed on May 20, 2014.

(51) Int. Cl.
*B65D 5/48* (2006.01)
*B65D 5/18* (2006.01)

(52) U.S. Cl.
CPC ..... *B65D 5/48002* (2013.01); *B65D 5/18* (2013.01)

(58) Field of Classification Search
CPC ..... B65D 5/48002; B65D 5/18; B65D 31/12
USPC ..... 229/120.11, 902, 903, 906, 120.18, 400, 229/405, 120.09, 149, 904; 206/541; 220/505
See application file for complete search history.

(56) References Cited

U.S. PATENT DOCUMENTS

| | | | | |
|---|---|---|---|---|
| 1,883,852 | A * | 10/1932 | Medoff | B65D 75/14 132/286 |
| 2,320,018 | A | 5/1943 | Martin | |
| 4,955,528 | A | 9/1990 | Schluckebier | |
| 5,720,429 | A | 2/1998 | Cordle | |
| 6,050,482 | A | 4/2000 | Cai | |
| 6,053,403 | A | 4/2000 | Cai | |
| 6,119,930 | A * | 9/2000 | Lunstra | B65D 5/008 229/116 |
| 6,216,946 | B1 | 4/2001 | Cai | |
| 6,561,414 | B1 | 5/2003 | Cai | |
| 8,584,884 | B2 | 11/2013 | Learn et al. | |

(Continued)

OTHER PUBLICATIONS

International Search Report dated Aug. 12, 2015 in International Application No. PCT/US15/31775.

*Primary Examiner* — Christopher R Demeree
(74) *Attorney, Agent, or Firm* — Baker Botts L.L.P.

(57) ABSTRACT

Food container includes a first body portion and a second body portion. The first and second body portions are joined proximate opposing sides thereof to define an interior of the container and a mouth to the interior. The container has a flat configuration with the first and second body portions in a generally planar condition and an expanded configuration with the first and second body portions in a contoured condition. First side flaps extending from the opposing sides of the first body portion are folded inwardly into the interior of the container. At least one of the first side flaps has an engagement feature disposed thereon disposed to engage the opposing first side flap when the container is the expanded configuration to form an interior dividing wall within the interior of the container. A unitary blank for forming a food container is also provided.

27 Claims, 12 Drawing Sheets

(56) References Cited

U.S. PATENT DOCUMENTS

2006/0016863 A1 1/2006 Holt et al.

* cited by examiner

CONTAINER WITH INNER DIVIDER

CROSS-REFERENCE TO RELATED APPLICATIONS

This application is a continuation of International Patent Application No. PCT/US2015/031775, filed May 20, 2015, which claims priority to U.S. Provisional Patent Application No. 62/000,704, filed May 20, 2014, which is incorporated by reference herein in its entirety.

BACKGROUND

Field of the Disclosed Subject Matter

The present disclosed subject matter relates to a food container for packaging and serving of food items, such as chicken nuggets, french fries, and other bite-size foods. Particularly, the present disclosed subject matter is directed to a container for holding food items, wherein the container has engagement features disposed to engage each other when the container is an expanded configuration to form an interior dividing wall within the interior of the container.

Description of Related Art

A variety of food items, such as french fries, onion rings, chicken nuggets, popcorn shrimp, and other bite-size foods, are often served from small paperboard containers. These food containers can be pouch-shaped, such as commonly used for french fries, or can be box-shaped and have a lid to contain the food item, such as deli items or the like. Exemplary food containers for packaging and serving a variety of food items are provided in U.S. Pat. Nos. 6,050,482; 6,053,403; 6,216,946; 6,561,414; and 8,584,884, each of which is incorporated by reference herein in its entirety.

Containers of this type can be formed of foldable paperboard, and can be a single-use product used in large quantities. As such, it can be desirable to reduce or minimize the costs associated with materials, manufacturing, storage, shipping, manner of use, and the like, of such containers.

It can also be desirable to provide a food container with a divider therein to separate the interior of the container into more than one portion or compartment. In this manner, each portion or compartment can contain a serving of a different product, with the different products separated by the divider.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a food container having a first body portion and a second body portion. The first and second body portions are joined proximate opposing sides thereof to define an interior of the container and a mouth to the interior. The container has a flat configuration with the first and second body portions in a generally planar condition and an expanded configuration with the first and second body portions in a contoured condition. The container further includes first side flaps extending from the opposing sides of the first body portion and folding inwardly into the interior of the container, and at least one of the first side flaps has an engagement feature disposed thereon. The engagement feature of the at least one first side flap is disposed to engage the opposing first side flap when the container is the expanded configuration to form an interior dividing wall within the interior of the container.

As embodied herein, at least one of the first body portion and the second body portion can have an arcuate first upper edge defining a portion of the mouth and extending toward the interior of the container. The other of the first body portion and the second body portion can have an arcuate second upper edge defining a portion of the mouth and extending away from the interior of the container. Additionally or alternatively, at least one of the first body portion and the second body portion can have bend lines extending along at least a portion of a length thereof to provide the contoured condition of the at least one of the first body portion and the second body portion.

Additionally, and as embodied herein, each first side flap can be defined in part by a first side flap fold line along at least a portion of a respective side of the first body portion. The at least one of the first side flaps can have a free end opposite the first side flap fold line with the engagement feature configured as a tab extending from the free end, and in some embodiments, the container can further have an opening defined therein to receive the tab when the container is in the expanded configuration. The engagement feature can further include a first interlocking hook disposed on the at least one of the first side flaps to engage a second interlocking hook disposed on the opposing first side flap when the container is in the expanded configuration to form the interior dividing wall. Additionally or alternatively, the container can further include second side flaps extending from opposing sides of the second body portion. In this manner, each second side flap can be defined in part by a second side flap fold line along at least a portion of a respective side of the second body portion, and each second side flap can be folded inwardly into the interior of the container. The at least one of the first side flaps and one of the second side flaps each can have a free end with an engagement feature configured as a tab extending from the free end. The tab of the at least one first side flap and the tab of the second side flap can be disposed adjacent to and aligned with each other, and in some embodiments, the container can further have an opening defined therein to receive the tab of the at least one first side flap and the tab of the second side flap when the container is in the expanded configuration. The opening can be defined by a gap between the first and second body portions.

Furthermore, and as embodied herein, the first side flaps can be secured to the second side flaps to join the first and second body portions proximate the opposing sides thereof. Each first side flap can be secured to a respective second side flap by an adhesive.

In addition, and as embodied herein, the engagement feature can be configured as an aperture defined in one of the first side flaps and one of the second side flaps. The aperture of the first side flap and the aperture of the second side flap can be disposed adjacent to and aligned with each other, and further the other of the first side flaps and the other of the second side flaps can be secured together at a discrete location disposed within the aperture of the first side flap and the aperture of the second side flap. The discrete location of each of the other of the first side flaps and the other of the second side flaps can include a raised surface. The other of the first side flaps and the other of the second side flaps can be secured together by an adhesive applied to the raised surfaces. The secured raised surfaces can be disposed at one region of the aperture when the container is in the flat configuration and can move toward another region of the aperture when the container urged toward the expanded configuration. When the container is in the expanded configuration, the secured raised surfaces can engage the first and second side flaps proximate the another region of the aperture.

In some embodiments, at least one of the first and second body portions can have a foldable support formed therein to hold a receptacle. The container can further include a base portion disposed between a base edge of the first body portion and a base edge of the second body portion. The base portion can have an upwardly arched condition extending toward the interior when the container is in the expanded configuration. Each of the first and second body portions can have a foot extending beyond the base edge to define a support surface.

The disclosed subject matter also includes a unitary blank for forming a food container including a first body portion and a second body portion aligned along a longitudinal axis. The first body portion and the second body portion each have a base edge and opposing sides. The base edge of the first body portion face the base edge of the second body portion. The blank further includes first side flaps extending laterally from the opposing sides of the first body portion. Each first side flap is defined in part by a first side flap fold line along at least a portion of a respective side of the first body portion. At least one of the first side flaps has an engagement feature disposed thereon. The engagement feature is disposed to engage the opposing first side flap when the first side flaps are folded along the first side flap fold lines and moved toward each other. The first side flaps form an interior dividing wall when the first and second body portions are joined proximate the opposing sides thereof to define a container having an interior.

Additionally, and as embodied herein, the at least one of the first side flaps can have a free end opposite the first side flap fold line with the engagement feature configured as a tab extending from the free end, and in some embodiments, the container formed from the blank can further have an opening defined therein to receive the tab.

Furthermore, and as embodied herein, the blank can further include second side flaps extending from opposing sides of the second body portion. Each second side flap can be defined in part by a second side flap fold line along at least a portion of a respective side of the second body portion, and in some embodiments, each second side flap can be configured to be folded inwardly into the interior of the container. The at least one of the first side flaps and one of the second side flaps each can have a free end with an engagement feature configured as a tab extending from the free end. The tab of the first side flap and the tab of the second side flap can be disposed adjacent to and aligned with each other, and in some embodiments, the container formed from the blank can further have an opening defined therein to receive the tab of the first side flap and the tab of the second side flap. The engagement feature can further include a first interlocking hook disposed on the at least one of the first side flaps to engage a second interlocking hook disposed on the opposing first side flap when the container is in the expanded configuration to form the interior dividing wall.

In addition, and as embodied herein, the engagement feature can be configured as an aperture defined in one of the first side flaps and one of the second side flaps. The aperture of the first side flap and the aperture of the second side flap can be spaced apart a similar distance from a corresponding base edge and aligned with each other. The engagement feature can further include a first interlocking hook disposed on the at least one of the first side flaps to engage a second interlocking hook disposed on the opposing first side flap when the container is in the expanded configuration to form the interior dividing wall. At least one of the first and second body portions can have a foldable support formed therein to hold a receptacle.

In some embodiments, the blank can further include a base panel disposed between the base edge of the first body portion and the base edge of the second body portion. The base panel can include a longitudinal base fold line extending substantially parallel with the base edges. The base panel can include at least one lateral base fold line substantially perpendicular to the longitudinal base fold line. The base panel can include arcuate fold lines on opposing sides of the lateral base fold line.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DESCRIPTION

Figure 1:
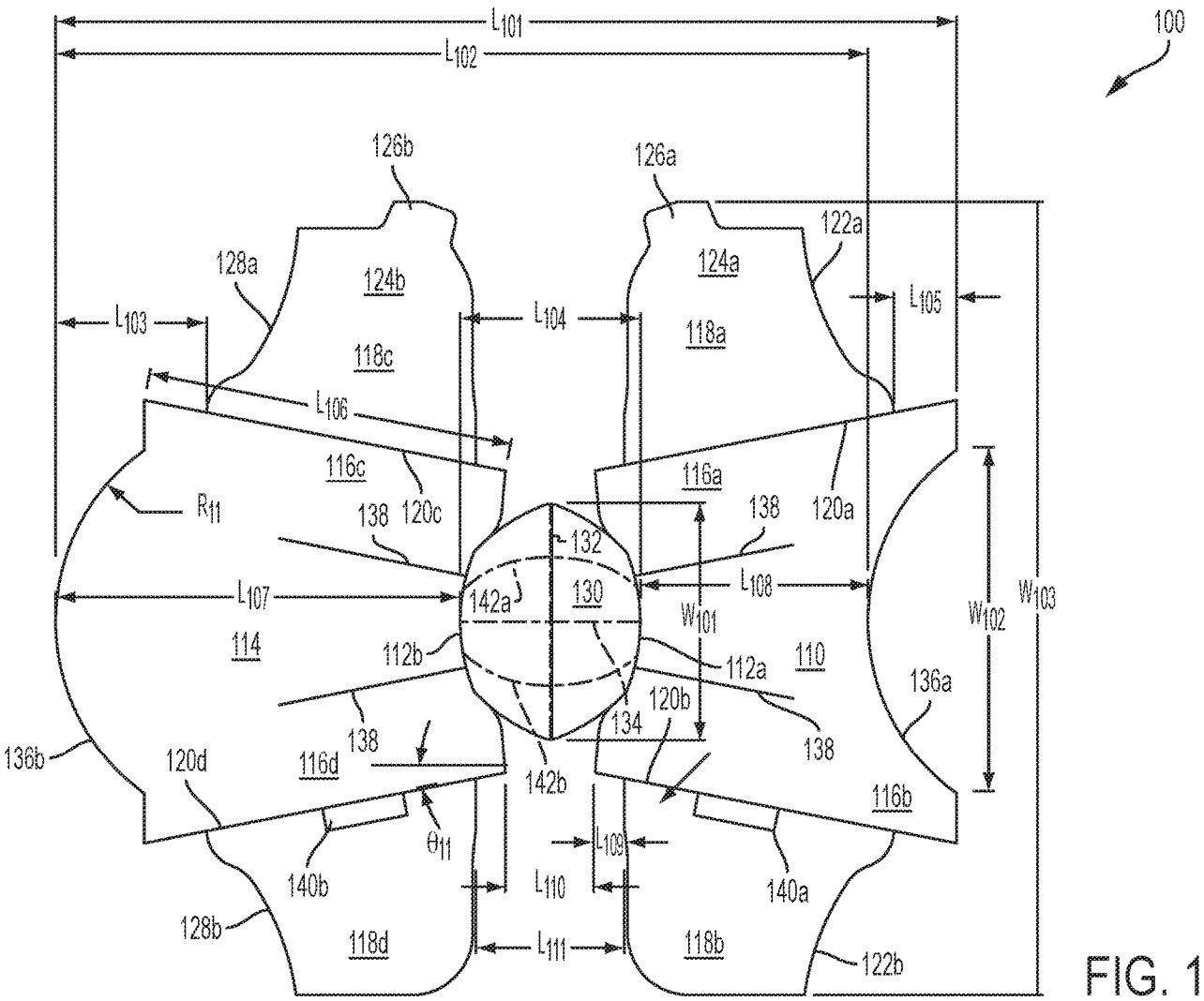
FIG. 1 is a plan view of an exemplary embodiment of a unitary blank for a food container in accordance with the disclosed subject matter.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein may be used for transport of food items and other perishable and non-perishable products. The disclosed subject matter is particularly suited for packaging and serving of food items, wherein the container has engagement features disposed to engage each other when the container is an expanded configuration to form an interior dividing wall within the interior of the container.

In accordance with the disclosed subject matter herein, the container generally includes a first body portion and a second body portion. The first and second body portions are joined proximate opposing sides thereof to define an interior of the container and a mouth to the interior. The container has a flat configuration with the first and second body portions in a generally planar condition and an expanded configuration with the first and second body portions in a contoured condition. The container further includes first side flaps extending from the opposing sides of the first body portion and folding inwardly into the interior of the container, and each first side flap has an engagement feature disposed thereon. The engagement features of the first side flaps are disposed to engage each other when the container is the expanded configuration to form an interior dividing wall within the interior of the container. A unitary blank for forming a food container is also provided.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-12. The container is suitable for use with a wide variety of hot and cold food items, such as fruit slices, chips, bread sticks, candies, and other suitable bite-size food items, particularly if typically consumed with a dipping sauce or the like. However, the container disclosed herein is particularly suitable and beneficial for use with hot, prepared food items, such as chicken nuggets, french fries, onion rings, and popcorn shrimp, wherein the container can be used for storing, transporting, and/or re-using such food items as well as serving of different type of products (e.g., chicken nuggets with french fries) each in separate portions or compartments in the container, with the portions or compartments and the different products therein separated by a divider. For purpose of illustration, and not limitation, reference will made herein to a container intended to contain food items.

Figure 2:
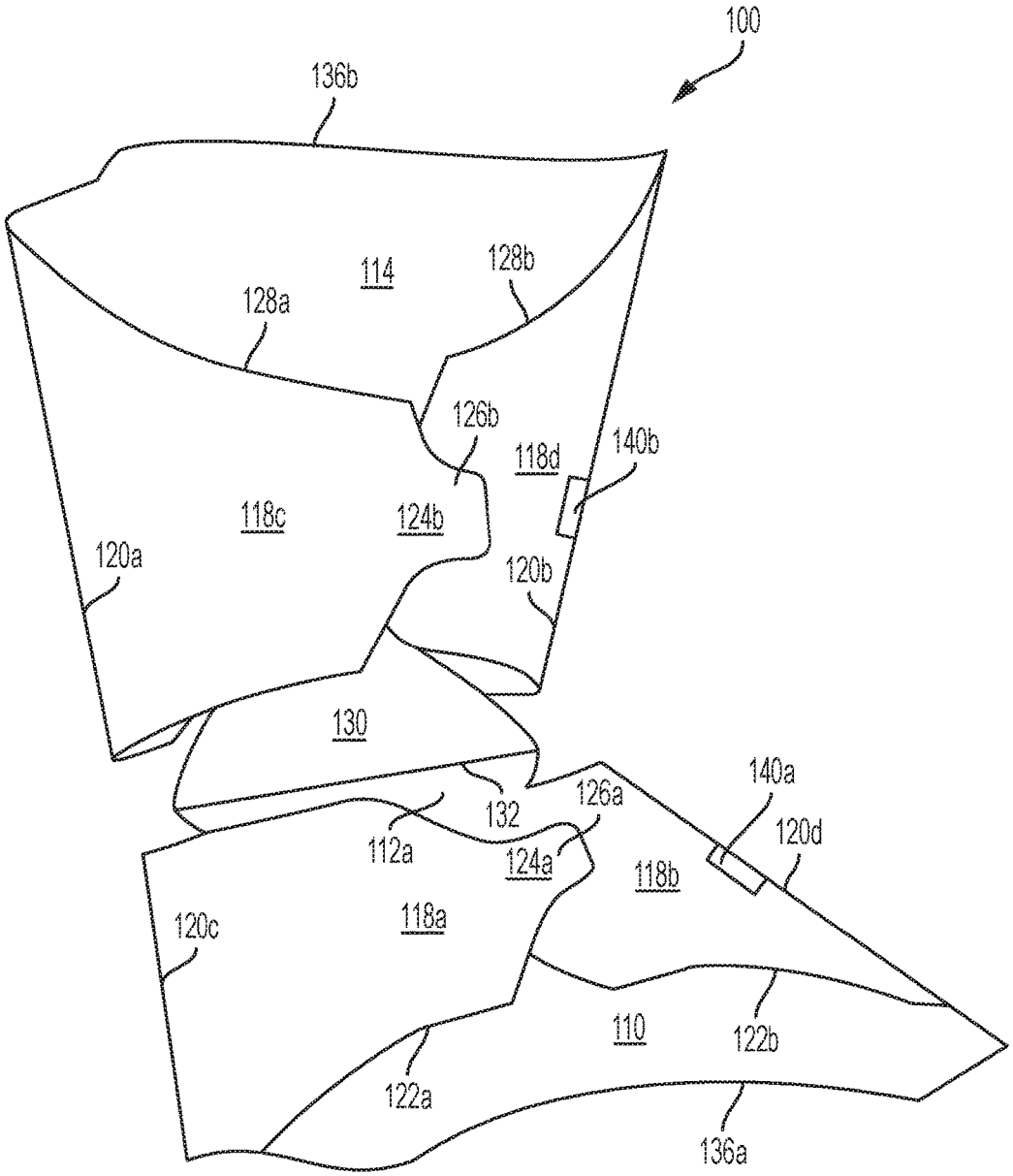
FIG. 2 is a perspective view of the unitary blank of FIG. 1, with corresponding side flaps folded inward.

For purpose of illustration and not limitation, reference is made to the exemplary embodiment of a unitary blank 100 for a container shown in FIGS. 1 and 2. Additionally, for purpose of understanding, reference is made in conjunction to the container 200 of FIG. 3 formed by the blank 100 of FIGS. 1 and 2.

Figure 3:
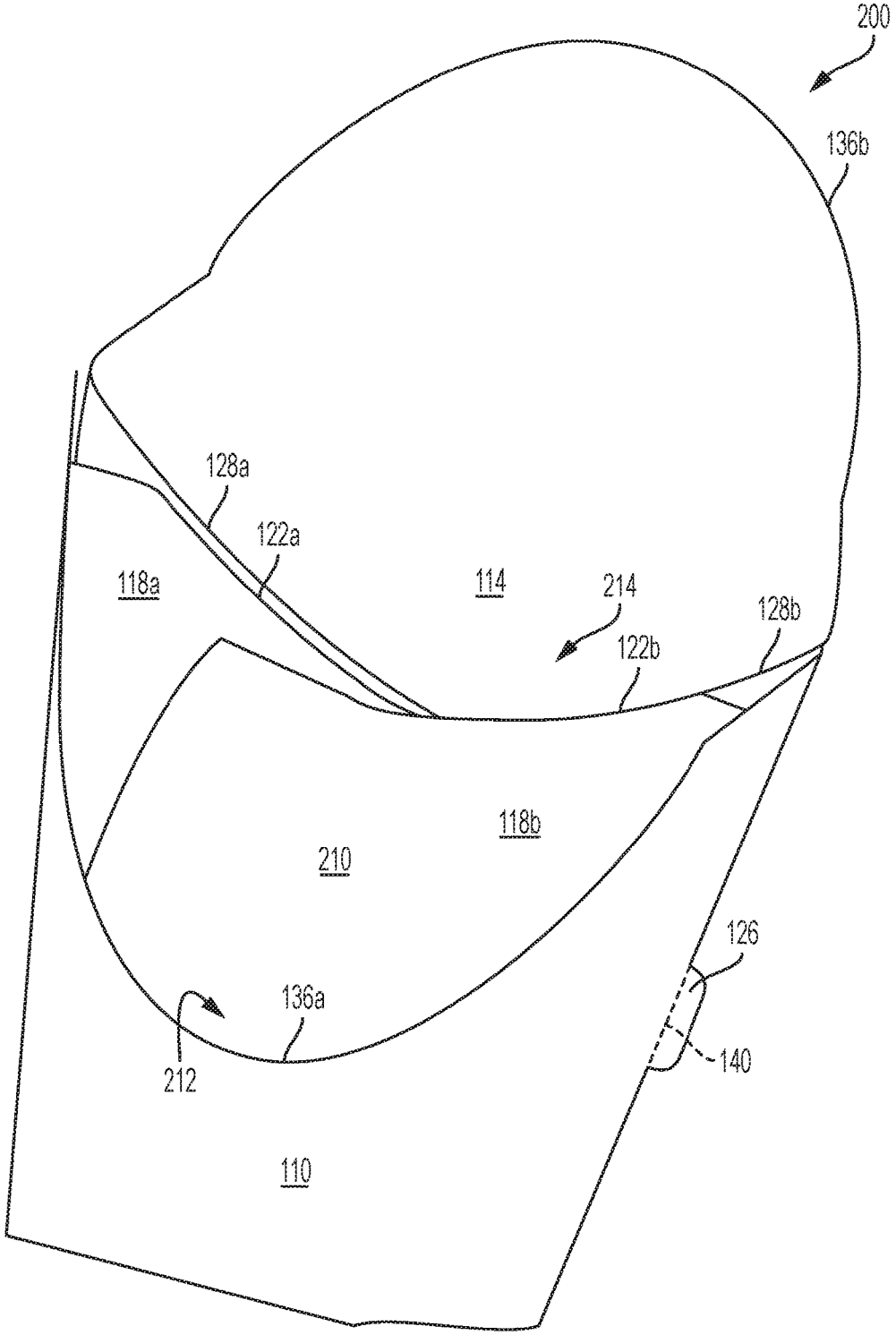
FIG. 3 is a right perspective view of an exemplary container formed from the unitary blank of FIG. 1.

As shown in FIGS. 1 and 2, the blank 100 generally includes a first body portion 110 and a second body portion 114 aligned along a longitudinal axis. The first body portion 110 and the second body portion 114 each have a base edge 112*a*, 112*b* and opposing sides 116*a*, 116*b*, 116*c*, 116*d*. The base edge 112*a* of the first body portion 110 face the base edge 112*b* of the second body portion 114. The blank 100 further includes first side flaps 118*a*, 118*b* extending laterally from the opposing sides 116*a*, 116*b* of the first body portion. Each first side flap 118*a*, 118*b* is defined in part by a first side flap fold line 120*a*, 120*b* along at least a portion of a respective side of the first body portion 110. Each first side flap 118*a*, 118*b* can have at least one contoured upper edge 122*a*, 122*b* extending from the first body portion 110. As shown in FIG. 3, and as discussed further below, the first side flaps 118*a*, 118*b* form an interior dividing wall 210 when the first and second body portions 110, 114 are joined proximate the opposing sides 116*a*, 116*b*, 116*c*, 116*d* thereof to define container 200 having an interior. With reference to FIG. 3, the interior dividing wall 210 can define a portion of and at least partially separate compartments 212, 214 in the interior of the container.

Additionally or alternatively, and as embodied herein, the blank 100 can include second side flaps 118*c*, 118*d* extending laterally from the opposing sides 116*c*, 116*d* of the second body portion. Each second side flap 118*c*, 118*d* is defined in part by a second side flap fold line 120*c*, 120*d* along at least a portion of a respective side of the second body portion 114. Each second side flap 118*c*, 118*d* can have at least one contoured upper edge 128*a*, 128*b* extending from the second body portion 114. As shown in FIG. 3, and as discussed further below, the second side flaps 118*c*, 118*d*, if provided, can further form interior dividing wall 210 when the first and second body portions 110, 114 are joined proximate the opposing sides 116*a*, 116*b*, 116*c*, 116*d* thereof to define container 200 having an interior.

For purpose of illustration and not limitation, and as embodied herein, at least one of the first body portion 110 and the second body portion 114 can have an arcuate first upper edge 136*a* defining a portion of the mouth and extending toward the interior of the container. The other of the first body portion 110 and the second body portion 114 can have an arcuate second upper edge 136*b* defining a portion of the mouth and extending away from the interior of the container. Additionally or alternatively, at least one of the first body portion 110 and the second body portion 114 can have bend lines 138 extending along at least a portion of a length thereof to provide the contoured condition of the at least one of the first body portion 110 and the second body portion 114.

As further embodied herein, the blank 100 can further include a base panel 130 disposed between the base edge 112*a* of the first body portion 110 and the base edge 112*b* of the second body portion 114. The base panel 130 can include a longitudinal base fold line 132 extending substantially parallel with the base edges 112*a*, 112*b*. The base panel 130 can include at least one lateral base fold line 134 substantially perpendicular to the longitudinal base fold line. The base panel 130 can include arcuate fold lines 142*a*, 142*b* on opposing sides of the lateral base fold line.

Additionally, and as embodied herein, blank 100 can have one or more engagement features to form container 200 with inner dividing wall 210. For purpose of illustration and not limitation, as embodied herein, one of the first side flaps 118*a* can have a free end 124*a* opposite the first side flap fold line 120*a* with a tab 126*a* extending therefrom. With reference to FIG. 3, tab 126*a* can form tab 126 of container 200 when the first side flap 118*a* is joined to the second side flap 118*c* to form container 200. As embodied herein, one of the second side flaps 118*c* can have a free end 124*b* with a tab 126*b* extending therefrom. The tab 126*a* of the first side flap 118*a* and the tab 126*b* of the second side flap 118*c* can be disposed adjacent to and aligned with each other to form tab 126 of container 200 when the first side flap 118*a* is joined to the second side flap 118*c* to form container 200, as described further below.

Furthermore, as shown for example in FIG. 3, the container 200 formed from the blank 100 can further have an opening 140 defined therein to receive the tab 126. For purpose of illustration and not limitation, as shown for example in FIGS. 1 and 2, opening 140 can be defined by an area 140*a* of a first side flap 118*b* and an area 140*b* of a second side flap 118*d* that is free of adhesive when the first side flap 118*b* is joined to the second side flap 118*d* to form the container.

With reference to FIGS. 1 and 2, as embodied herein, container 200 can be formed from blank 100 by folding first side flap 118*b* and second side flap 118*d* inwardly along first side flap fold line 120*b* and second side flap fold line 120*d*, respectively, and folding first side flap 118*a* and second side flap 118*c* inwardly along first side flap fold line 120*a* and second side flap 120*c*, respectively. In this manner, as shown for example in FIG. 2, first side flap 118*a* can at least partially overlap first side flap 118*b*, and second side flap 118*c* can at least partially overlap second side flap 118*d*. Additionally, and as embodied herein, first side flap 118*a* can be joined to second side flap 118*c* proximate first side flap fold line 120*a* and second side flap fold line 120*c*. Furthermore, and as embodied herein, first side flap 118*b* can be joined to second side flap 118*d* proximate first side flap fold line 120*b* and second side flap fold line 120*d*, with areas 140*a* and 140*b* free of adhesive to form opening 140 (shown in FIG. 3).

In this configuration, the joined pair of flaps 118*a*, 118*c* can move inwardly independently of joined pair of flaps 118*b*, 118*d*, with flaps 118*a*, 118*c* moving inside and between joined flaps 118*b*, 118*d* from an initial flat configuration toward the expanded configuration. As the container 200 is further urged toward the expanded configuration, tabs 126*a*, 126*b* move through non-adhesively joined areas 140*a*, 140*b* of joined flaps 118*b*, 118*d*. As embodied herein, areas 140*a*, 140*b* can form opening 140 having a size to engage joined tabs 126*a*, 126*b* within joined flaps 118*b*, 118*d* in a frictional engagement. In this manner, first and second body portions 110, 114 can be secured in a contoured condition with divider wall 210 formed therebetween, as shown for example in FIG. 3, with or without additional engagement features, as described further below. With reference to FIG. 3, in the contoured configuration, contoured upper edges 122*a*, 122*b* of first side flaps 118*a*, 118*b* and contoured upper edges 128*a*, 128*b* of second side flaps 118*c*, 118*d* can define a contoured upper edge of the interior dividing wall 210, which can facilitate access to compartments 212, 214 in the interior of the container.

In addition, and as embodied herein, at least one of the first and second body portions 110, 114 can have a foldable support formed therein to hold a receptacle, as shown and described for example in U.S. Pat. No. 8,584,884, which is incorporated by reference herein in its entirety.

Figure 4:
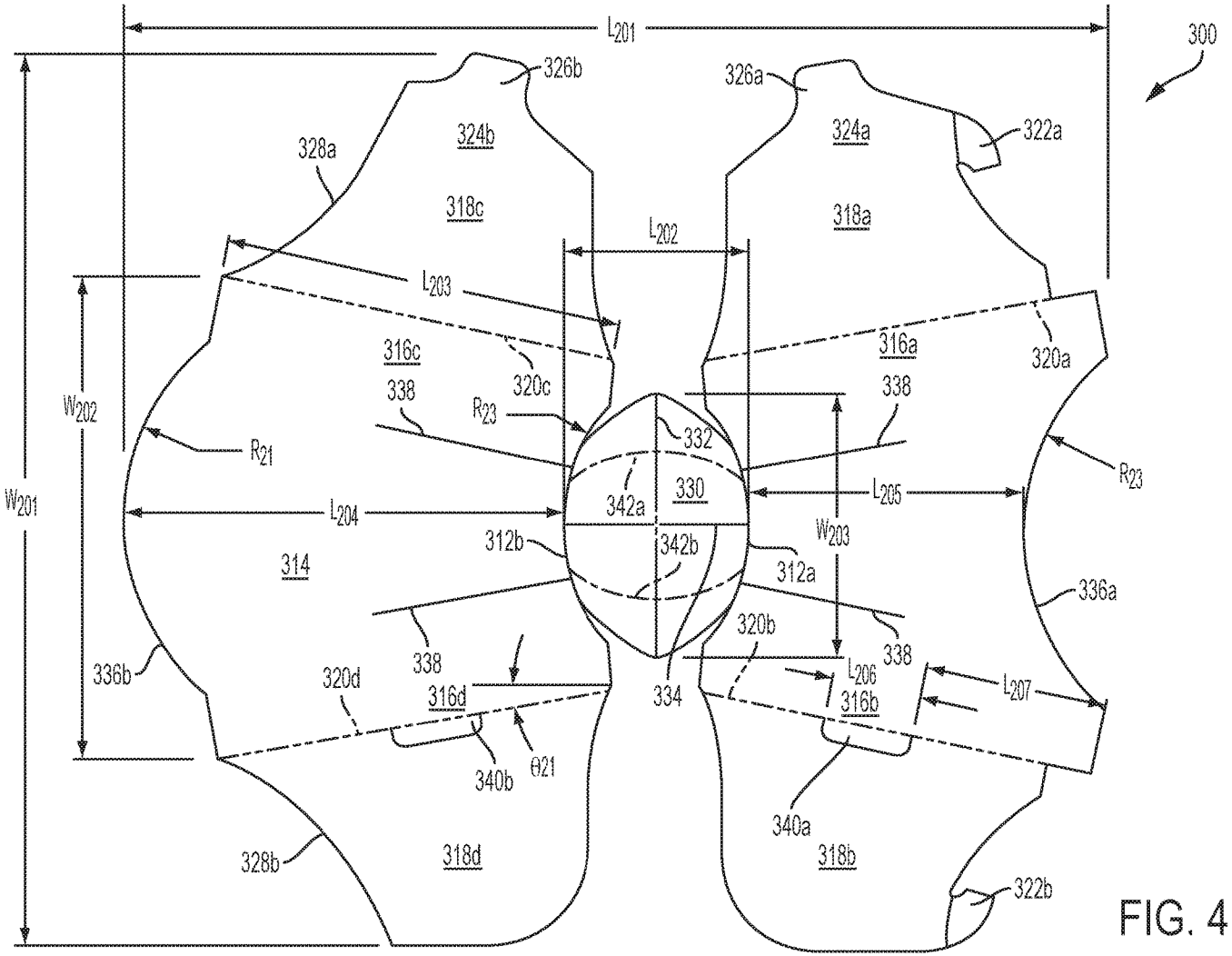
FIG. 4 is a plan view of another exemplary embodiment of a unitary blank for a food container in accordance with the disclosed subject matter.
Figure 5:
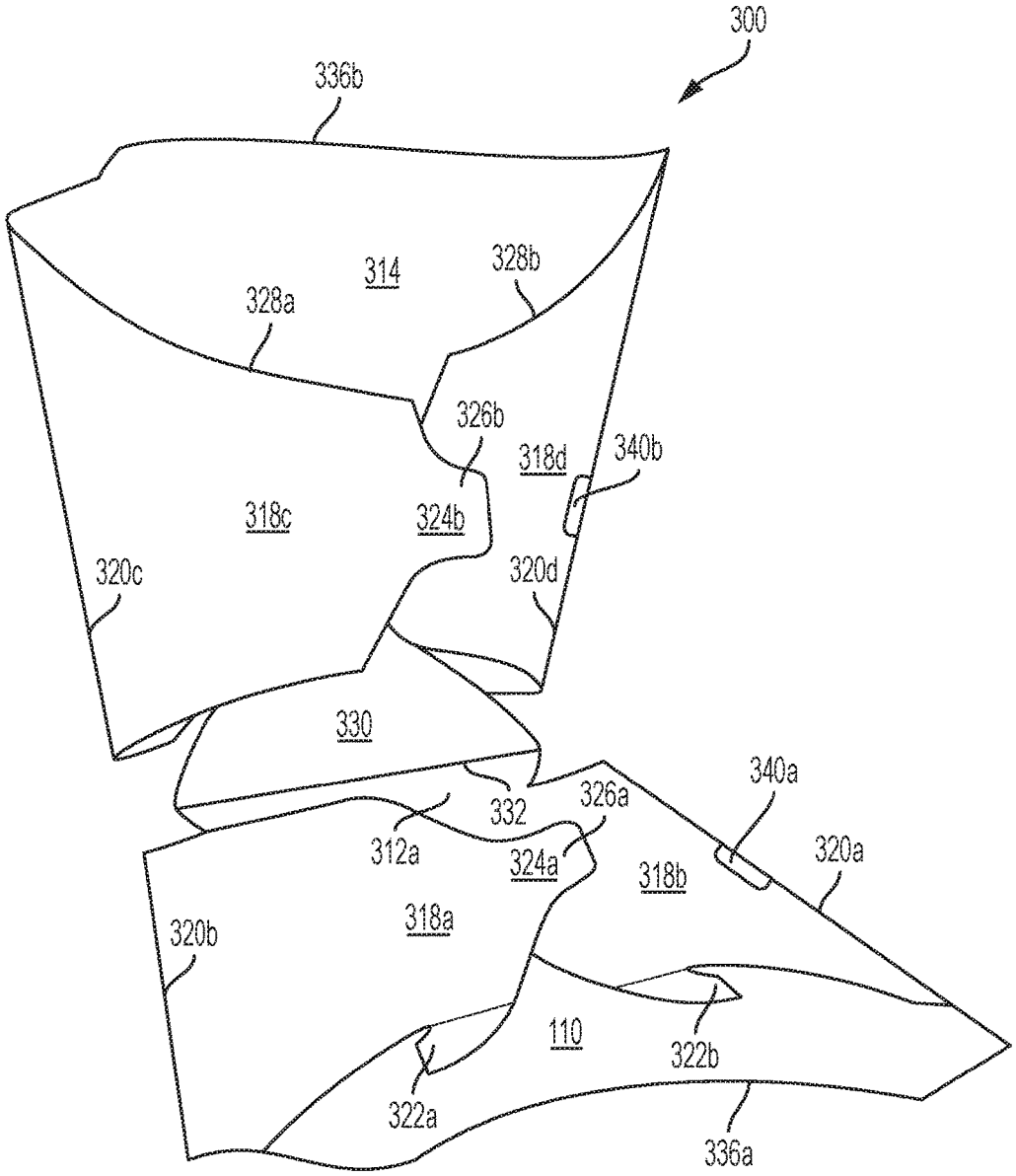
FIG. 5 is a perspective view of the unitary blank of FIG. 4, with corresponding side flaps folded inward.
Figure 6:
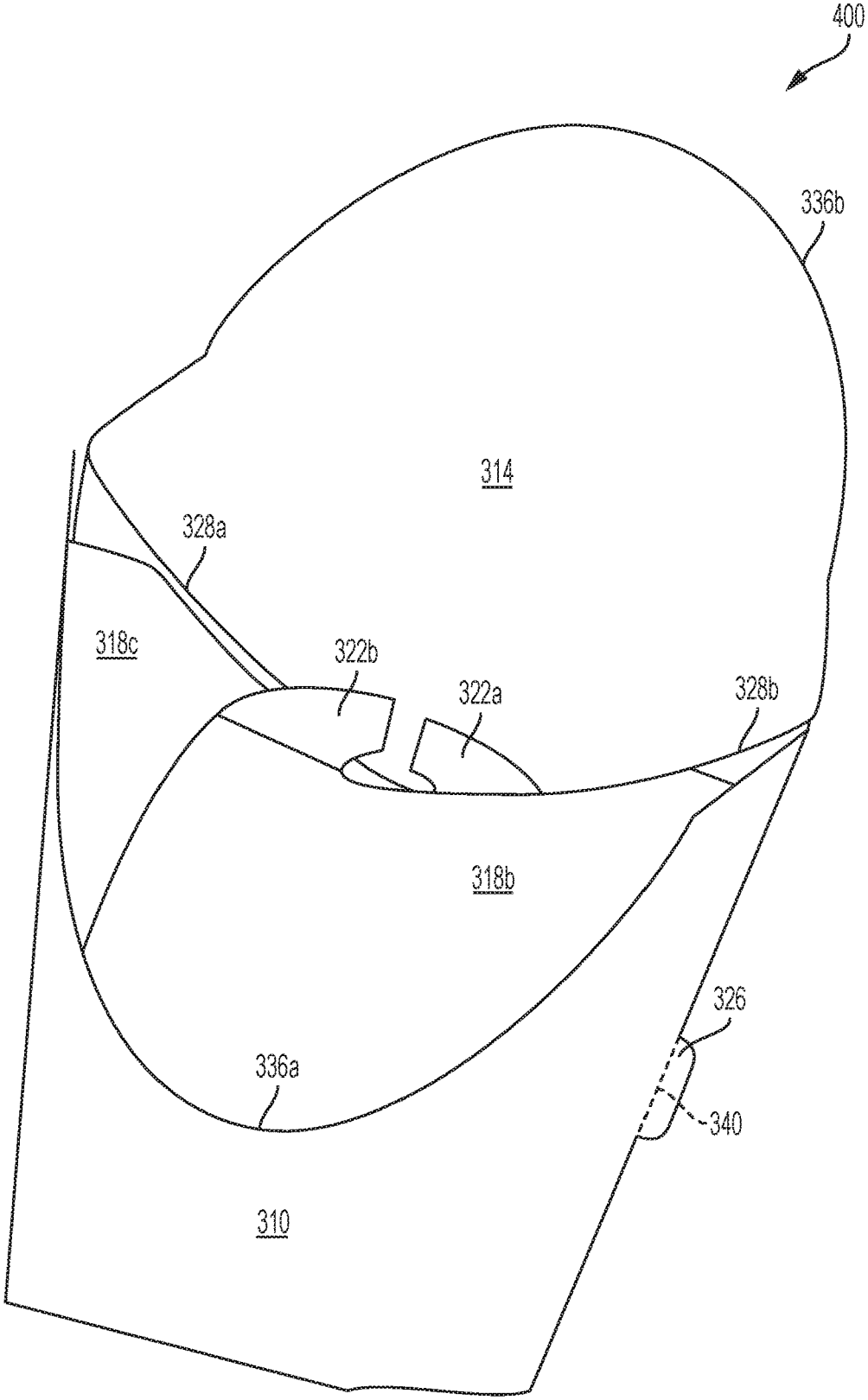
FIG. 6 is a right perspective view of an exemplary container formed from the unitary blank of FIG. 4, with additional engagement features of the container not engaged.
Figure 7:
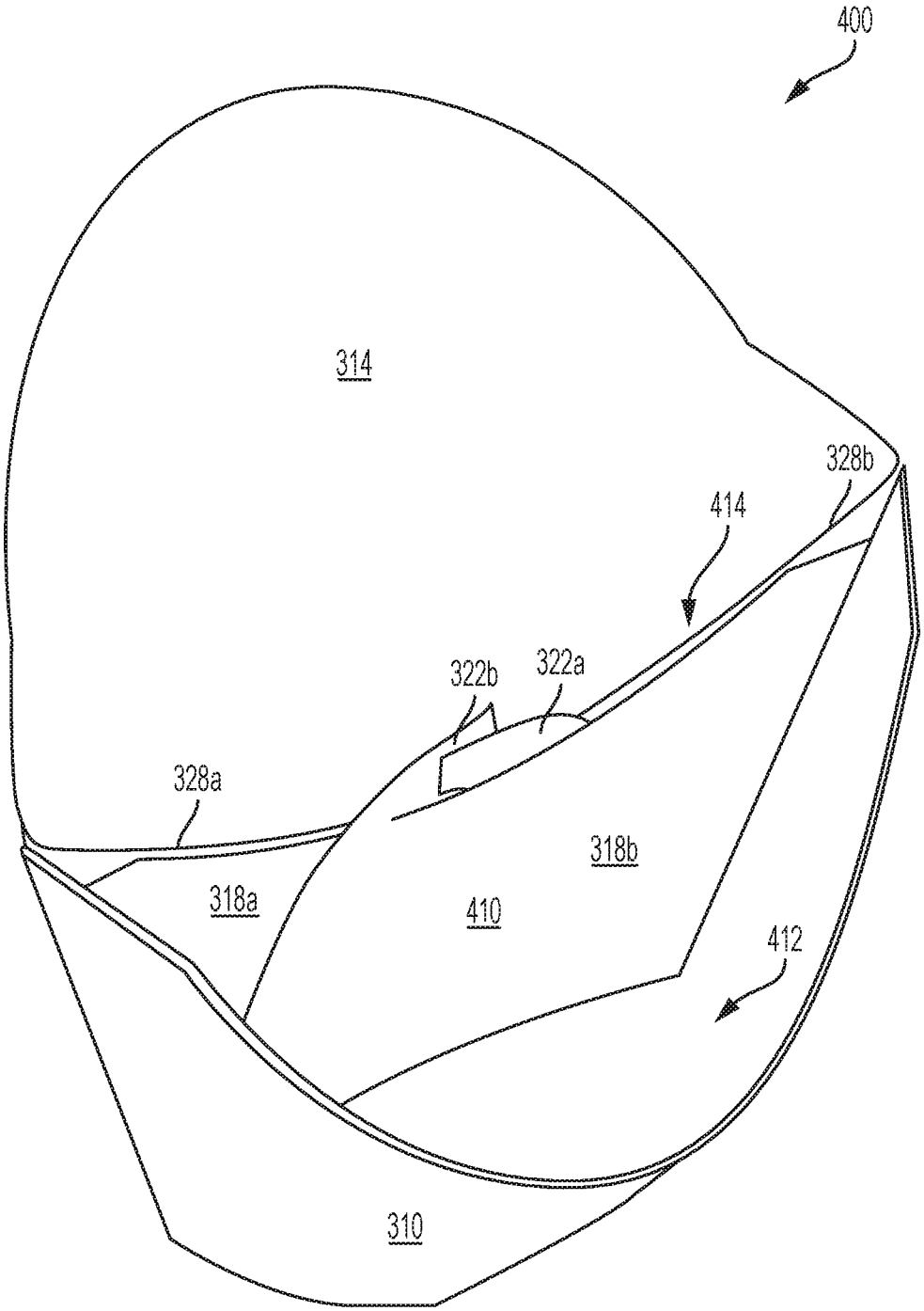
FIG. 7 is a left perspective view the exemplary container of FIG. 6, with the additional engagement features engaged with each other.

Reference is made now to an alternative embodiment of a unitary blank 300 for a container shown in FIGS. 4 and 5, in conjunction with container 600 of FIGS. 6 and 7 formed by the blank 400 of FIGS. 4 and 5. The unitary blank 300 and container 400 can include some or all of the various features described herein with respect to unitary blank 100 and container 200.

As shown in FIGS. 4 and 5, the blank 300 generally includes a first body portion 310 and a second body portion 314 aligned along a longitudinal axis. The first body portion 310 and the second body portion 314 each have a base edge 312*a*, 312*b* and opposing sides 316*a*, 316*b*, 316*c*, 316*d*. The base edge 312*a* of the first body portion 310 face the base edge 312*b* of the second body portion 314. The blank 300 further includes first side flaps 318*a*, 318*b* extending laterally from the opposing sides 316*a*, 316*b* of the first body portion. Each first side flap 318*a*, 318*b* is defined in part by a first side flap fold line 320*a*, 320*b* along at least a portion of a respective side of the first body portion 310. As shown in FIGS. 6 and 7, and as discussed further below, the first side flaps 318*a*, 318*b* form an interior dividing wall 410 when the first and second body portions 310, 314 are joined proximate the opposing sides 316*a*, 316*b*, 316*c*, 316*d* thereof to define container 400 having an interior. With reference to FIGS. 6 and 7, the interior dividing wall 410 can define a portion of and at least partially separate compartments 412, 414 in the interior of the container.

Additionally or alternatively, and as embodied herein, the blank 300 can include second side flaps 318*c*, 318*d* extending laterally from the opposing sides 316*c*, 316*d* of the second body portion. Each second side flap 318*c*, 318*d* is defined in part by a second side flap fold line 320*c*, 320*d* along at least a portion of a respective side of the second body portion 314. Each second side flap 318*c*, 318*d* can have at least one contoured upper edge 328*a*, 328*b* extending from the second body portion 314. As shown in FIG. 3, and as discussed further below, the second side flaps 318*c*, 318*d*, if provided, can further form interior dividing wall 410 when the first and second body portions 310, 314 are joined proximate the opposing sides 316*a*, 316*b*, 316*c*, 316*d* thereof to define container 400 having an interior.

As embodied herein, at least one of the first body portion 310 and the second body portion 314 can have an arcuate first upper edge 336*a* defining a portion of the mouth and extending toward the interior of the container. The other of the first body portion 310 and the second body portion 314 can have an arcuate second upper edge 336*b* defining a portion of the mouth and extending away from the interior of the container. Additionally or alternatively, at least one of the first body portion 310 and the second body portion 314 can have bend lines 338 extending along at least a portion of a length thereof to provide the contoured condition of the at least one of the first body portion 310 and the second body portion 314.

As further embodied herein, the blank 300 can also include a base panel 330 disposed between the base edge 312*a* of the first body portion 310 and the base edge 312*b* of the second body portion 314. The base panel 330 can include a longitudinal base fold line 332 extending substantially parallel with the base edges 312*a*, 312*b*. The base panel 330 can include at least one lateral base fold line 334 substantially perpendicular to the longitudinal base fold line. The base panel 330 can include arcuate fold lines 342*a*, 342*b* on opposing sides of the lateral base fold line.

Furthermore, and as embodied herein, blank 300 can have one or more engagement features to form container 400 with inner dividing wall 410. For example, and as embodied herein, each first side flap 318*a*, 318*b* can have engagement features in the form of opposing hooks 322*a*, 322*b* extending from the first body portion 310. With reference to FIGS. 6 and 7, the hooks 322*a*, 322*b* are disposed to engage each other when the first side flaps 318*a*, 318*b* are folded along the first side flap fold lines 320*a*, 320*b* and moved toward each other. As shown for example in FIGS. 4 and 6, hooks 322*a*, 322*b* can be formed with edges and corners defining the interlocking hooks. Alternatively, in some embodiments, hooks 322*a*, 322*b* can be configured with rounded or smoothed corners and/or rounded or smoothed edges.

Additionally, and as set forth above, engagement features can be provided in the form of tabs. For purpose of illustration and not limitation, as embodied herein, one of the first side flaps 318*a* can have a free end 324*a* opposite the first side flap fold line 320*a* with a tab 326*a* extending therefrom. With reference to FIG. 6, tab 326*a* can form tab 326 of container 400 when first side flap 318*a* is joined to second side flap 318*c* to form container 400. As embodied herein, one of the second side flaps 318*c* can have a free end 324*b* with a tab 326*b* extending therefrom. The tab 326*a* of the first side flap 318*a* and the tab 326*b* of the second side flap 318*c* can be disposed adjacent to and aligned with each other to form tab 326 of container 400 when the first side flap 318*a* is joined to the second side flap 318*c* to form container 200, as described further below.

Furthermore, and as set forth above, the container 400 formed from the blank 300 can further have an opening 340 defined therein to receive the tab 326. The opening 340 can be defined by an area 340*a* of first side flap 318*b* and an area 340*b* of second side flap 318*d* that is free of adhesive when first side flap 318*b* is joined to second side flap 318*d* to form the container.

With reference to FIGS. 4 and 5, as embodied herein, container 400 can be formed from blank 300 by folding first side flap 318*b* and second side flap 318*d* inwardly along first side flap fold line 320*b* and second side flap fold line 320*d*, respectively, and folding first side flap 318*a* and second side flap 318*c* inwardly along first side flap fold line 320*a* and second side flap 320*c*, respectively. In this manner, as shown for example in FIG. 5, first side flap 318*a* can at least partially overlap first side flap 318*b*, and second side flap 318*c* can at least partially overlap second side flap 318*d*. Additionally, and as embodied herein, first side flap 318*a* can be joined to second side flap 318*c* proximate first side flap fold line 320*a* and second side flap fold line 320*c*. Furthermore, and as embodied herein, first side flap 318*b* can be joined to second side flap 318*d* proximate first side flap fold line 320*b* and second side flap fold line 320*d*, with areas 340*a* and 340*b* free of adhesive to form opening 340 (shown in FIG. 6).

In this configuration, the joined pairs of flaps can move inwardly independently of each other from an initial flat configuration into the expanded configuration with the first and second body portions 310, 314 in a contoured condition, as shown for example in FIGS. 6 and 7. With reference to FIGS. 6 and 7, in the contoured configuration, contoured upper edges of first side flaps 318*a*, 318*b* and contoured upper edges 328*a*, 328*b* of second side flaps 318*c*, 318*d* can define a contoured upper edge of the interior dividing wall 410, which can facilitate access to compartments 412, 414 in the interior of the container.

In addition, and as embodied herein, at least one of the first and second body portions 310, 314 can have a foldable support formed therein to hold a receptacle, as shown and described for example in U.S. Pat. No. 8,584,884, which is incorporated by reference herein in its entirety.

Figure 8:
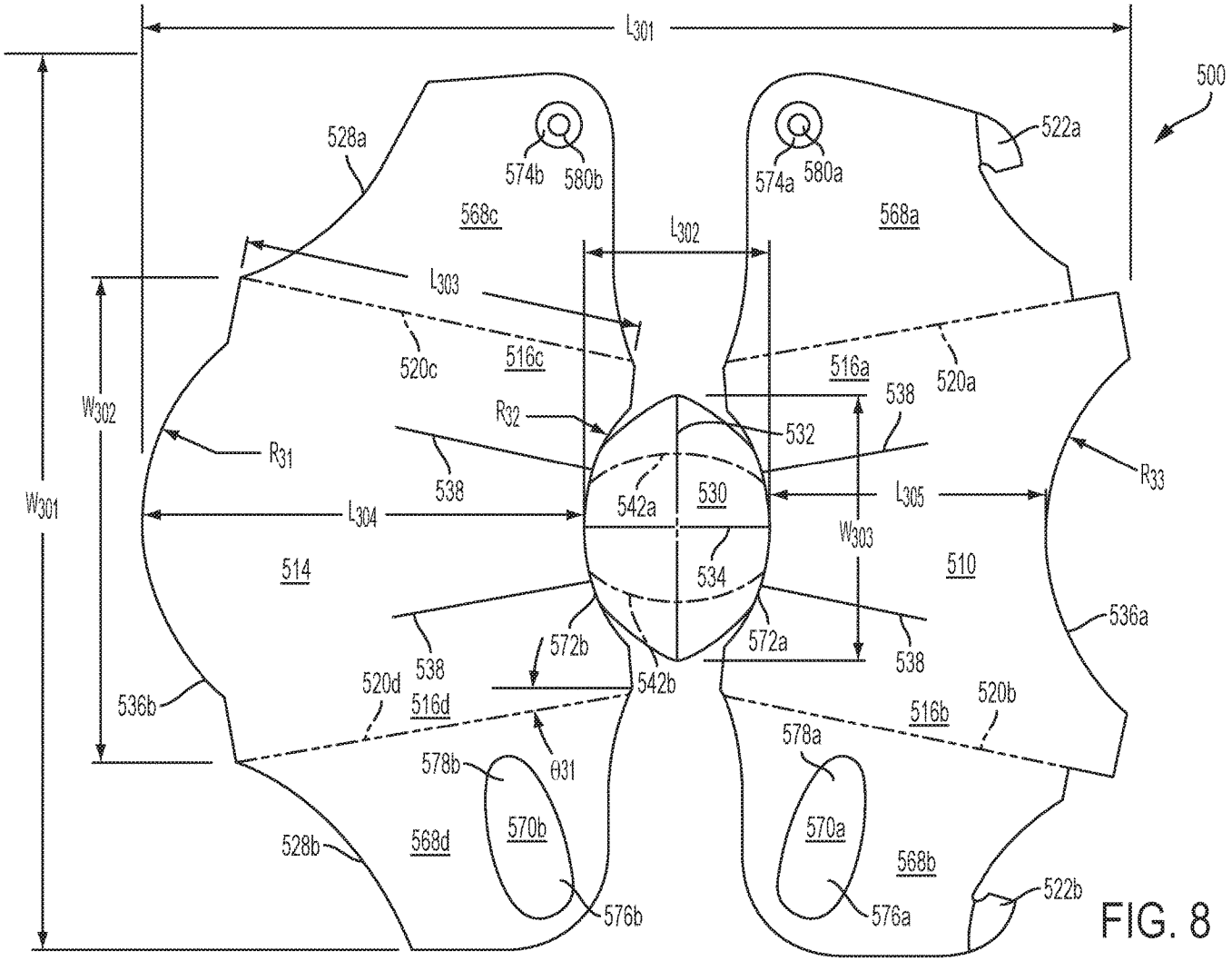
FIG. 8 is a plan view of another exemplary embodiment of a unitary blank for a food container in accordance with the disclosed subject matter.
Figure 9:
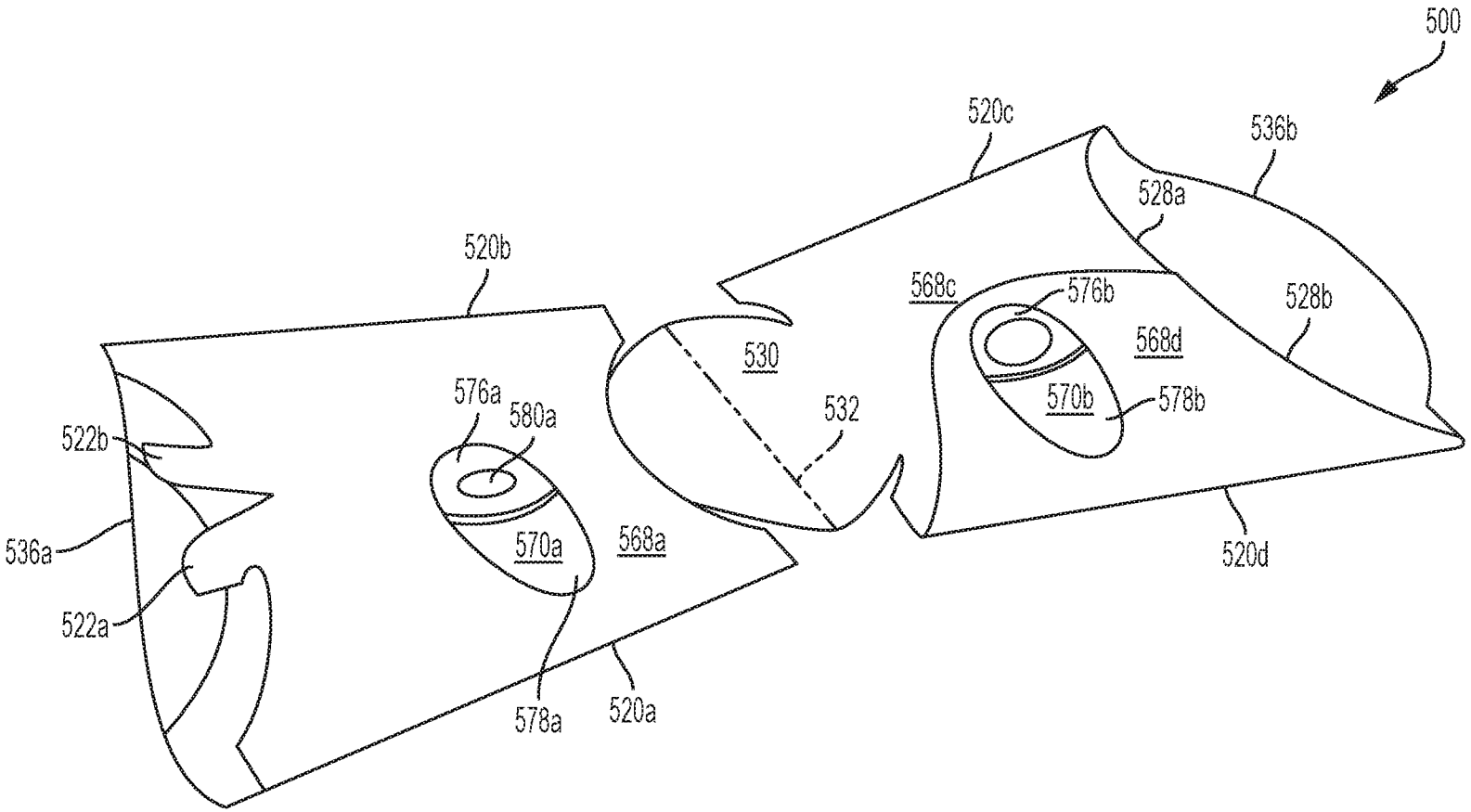
FIG. 9 is a right perspective view of the unitary blank of FIG. 8, with corresponding side flaps folded inward.
Figure 10:
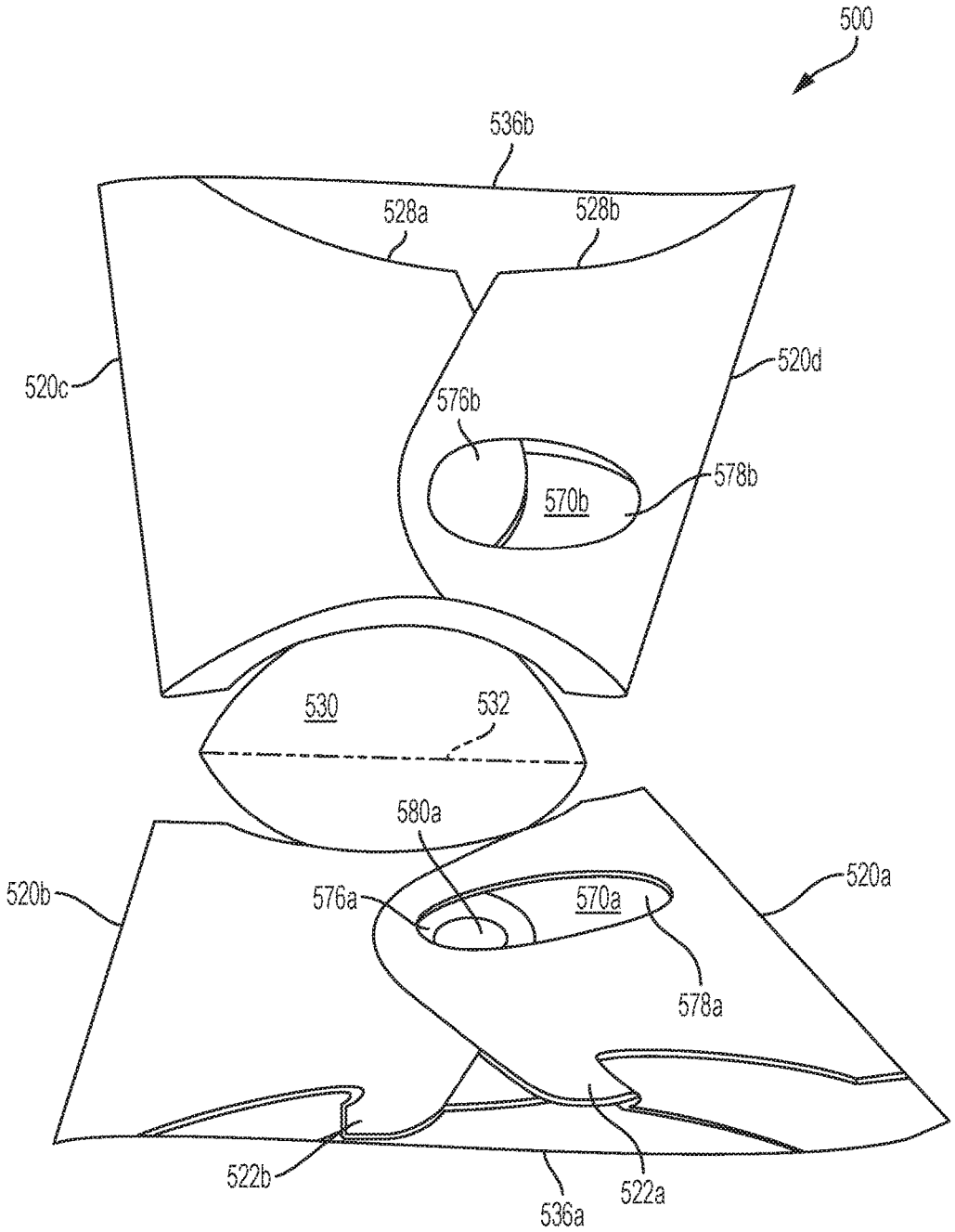
FIG. 10 is a top perspective view of the unitary blank of FIG. 8, with a first body portion folded toward a second body portion.
Figure 11:
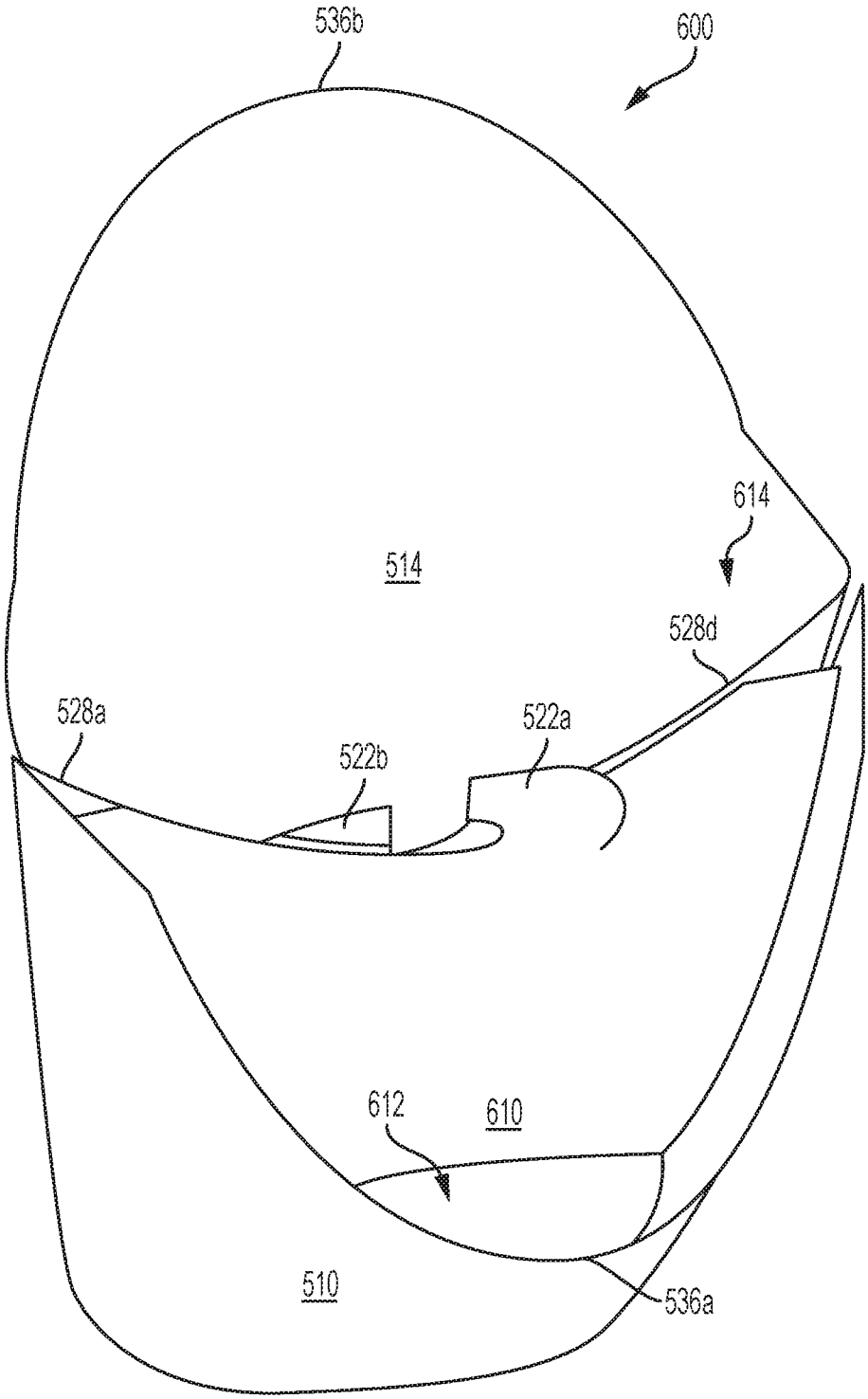
FIG. 11 is a left perspective view of an exemplary container formed from the unitary blank of FIG. 8, with additional engagement features of the container not engaged.
Figure 12:
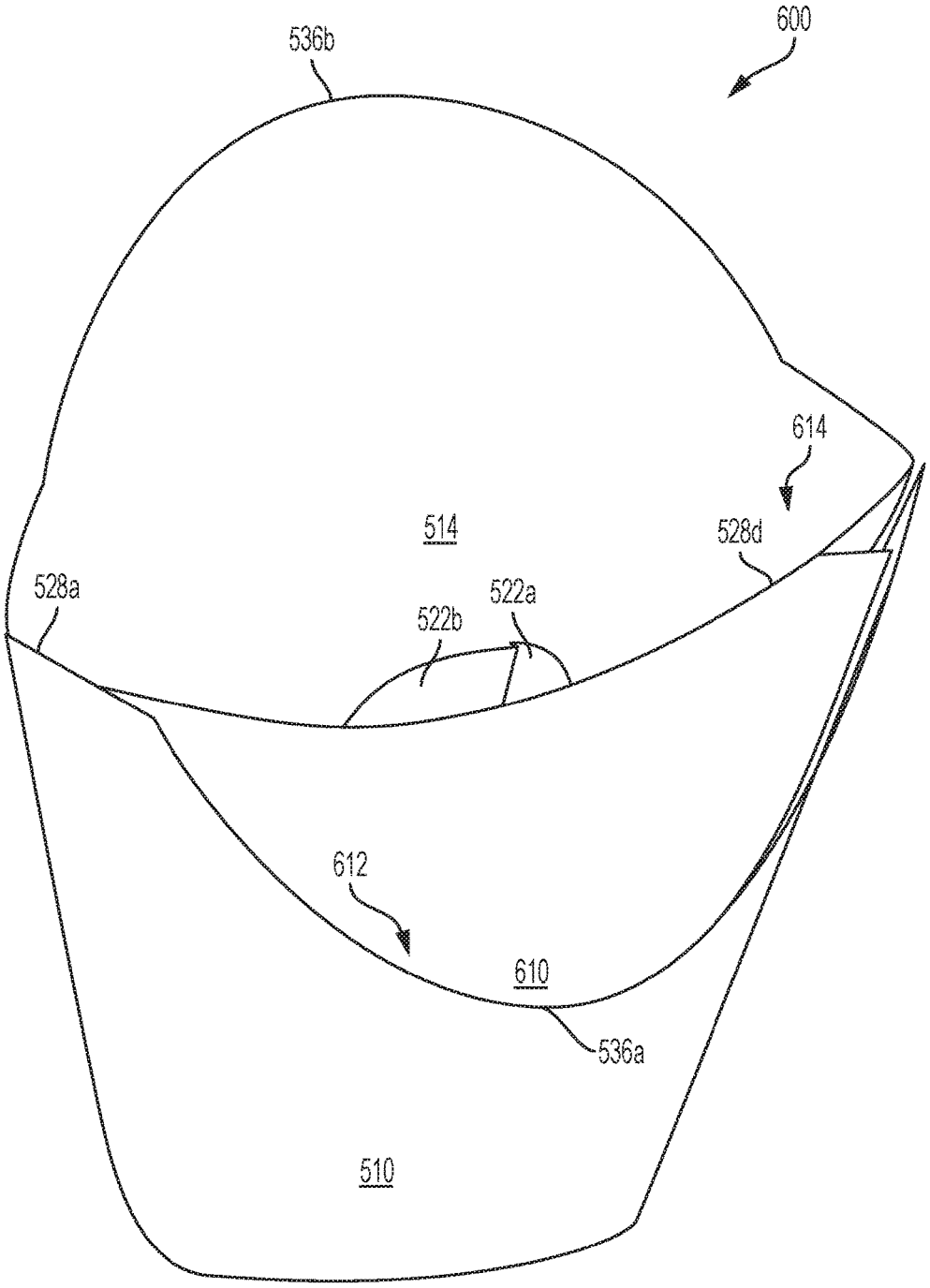
FIG. 12 is a left perspective view the exemplary container of FIG. 11, with the additional engagement features engaged with each other.

Reference is made now to another alternative embodiment of a unitary blank 500 for a container shown in FIGS. 8-10, in conjunction with container 600 of FIGS. 11 and 12 formed by the blank 500 of FIGS. 8-10. The unitary blank 500 and container 600 can include some or all of the various features described herein with respect to unitary blank 100 and container 200 and/or blank 300 and container 400.

As shown in FIGS. 8-10, the blank 500 generally includes a first body portion 510 and a second body portion 514 aligned along a longitudinal axis. The first body portion 510 and the second body portion 514 each have a base edge 512*a*, 512*b* and opposing sides 516*a*, 516*b*, 516*c*, 516*d*. The base edge 512*a* of the first body portion 510 face the base edge 512*b* of the second body portion 514. The blank 500 further includes first side flaps 518*a*, 518*b* extending laterally from the opposing sides 516*a*, 516*b* of the first body portion. Each first side flap 518*a*, 518*b* is defined in part by a first side flap fold line 520*a*, 520*b* along at least a portion of a respective side of the first body portion 510. As shown in FIGS. 11 and 12, and as discussed further below, the first side flaps 518*a*, 518*b* form an interior dividing wall 610 when the first and second body portions 510, 514 are joined proximate the opposing sides 516*a*, 516*b*, 516*c*, 516*d* thereof to define container 600 having an interior. With reference to FIGS. 11 and 12, the interior dividing wall 610 can define a portion of and at least partially separate compartments 612, 614 in the interior of the container 600.

As embodied herein, at least one of the first body portion 510 and the second body portion 514 can have an arcuate first upper edge 536*a* defining a portion of the mouth and extending toward the interior of the container. The other of the first body portion 510 and the second body portion 514 can have an arcuate second upper edge 536*b* defining a portion of the mouth and extending away from the interior of the container. Additionally or alternatively, at least one of the first body portion 510 and the second body portion 514 can have bend lines 538 extending along at least a portion of a length thereof to provide the contoured condition of the at least one of the first body portion 510 and the second body portion 514.

Furthermore, and as embodied herein, blank 500 can have one or more engagement features to form container 600 with inner dividing wall 610. For example, with reference to FIG. 8, blank 500 can have an engagement feature in the form of a raised surface disposed within an aperture, as described below. For example, and as embodied herein, one of the first side flaps 568*b* and one of the second side flaps 568*d* each can have an aperture 570*a*, 570*b* defined therein. Aperture 570*a* of the first side flap 568*b* and aperture 570*b* of the second side flap 568*d* each can be spaced apart a similar distance from a corresponding base edge 572*a*, 572*b* and aligned with each other. The other of the first side flaps 568*a* and the other of the second side flaps 568*c* can be secured together at a discrete location 574*a*, 574*b*, which can be disposed within the aperture 570*a* of the first side flap 568*b* and the aperture 570*b* of the second side flap 568*d*. Each second side flap 568*c*, 568*d* can have at least one contoured upper edge 528*a*, 528*b* extending from the second body portion 514.

Additionally, and as embodied herein, the discrete location 574*a*, 574*b* of each of the other of the first side flaps 568*a* and the other of the second side flaps 568*c* can include a raised surface 580*a*, 580*b*. The other of the first side flaps 568*a* and the other of the second side flaps 568*c* can be secured together by an adhesive applied to the raised surfaces 580*a*, 580*b* at the discrete location 574*a*, 574*b*. For example, and as embodied herein, first side flap 568*a* and second side flap 568*c* can be folded inwardly, and first side flap 568*b* and second side flap 568*d* can be folded inwardly. In this manner, first side flap 568*b* can at least partially overlap first side flap 568*a*, and second side flap 568*d* can at least partially overlap second side flap 568*c*. Furthermore, and as embodied herein, in this configuration, raised surfaces 580*a*, 580*b* of discrete locations 574*a*, 574*b* of first side flap 568*a* and second side flap 568*c*, respectively, can be exposed through apertures 570*a*, 570*b* in overlapping first side flap 568*b* and second side flap 568*d*. Adhesive can be applied to the raised surfaces 580*a*, 580*b*, and the corresponding first side flap 568*a* and second side flap 568*c* can be joined and adhesively secured together proximate the raised surfaces 580, 580*b*.

The joined first side flap 568*a* and second side flap 568*c* can move, for example and without limitation, within apertures 570*a*, 570*b* of the joined first side flap 568*b* and second side flap 568*d* from an initial flat configuration into the expanded configuration with corresponding body panels in a contoured condition. That is, as shown for example and without limitation in FIGS. 11 and 12, the secured raised surfaces 580*a*, 580*b* at the discrete location 574*a*, 574*b* can be disposed at one region 576*a*, 576*b* of the aperture 570*a*, 570*b* when container 600 is in the flat configuration. The secured raised surfaces 580*a*, 580*b* at the discrete location 574*a*, 574*b* can move toward another region 578*a*, 578*b* of the aperture 570*a*, 570*b* when container 600 is urged toward the expanded configuration. When container 600 is in the expanded configuration, the secured raised surfaces 580*a*, 580*b* can engage the first and second side flaps 568*b*, 568*d* proximate the another region 578*a*, 578*b* of the aperture 570*a*, 570*b*. With reference to FIGS. 11 and 12, in the contoured configuration, contoured upper edges 528*a*, 528*b* of second side flaps 568*c*, 568*d* can define a contoured upper edge of the interior dividing wall 610, which can facilitate access to compartments 612, 614 in the interior of the container.

Additionally, and as set forth above, engagement features can be provided in the form of hooks. For example, and as embodied herein, each first side flap 568*a*, 568*b* can have opposing hooks 522*a*, 522*b* extending from the first body portion 510. With reference to FIGS. 11 and 12, the hooks 522*a*, 522*b* are disposed to engage each other when the first side flaps 568*a*, 568*b* are folded along the first side flap fold lines 520*a*, 520*b* and moved toward each other. Additionally, or alternatively, and as set forth above, engagement features can be provided in the form of tabs (not shown).

The containers disclosed herein are preferably disposable, but it is contemplated that they may be reused at a future time. Also, the containers can be constructed from materials suitable to be placed in a heating apparatus, such as a microwave, to heat the food and/or used for storage in the refrigerator or freezer. Additionally, the materials from which the food containers are made need not be the same throughout. The containers and blanks described herein can be manufactured from any suitable material, including but not limited to paperboard.

It is to be recognized that the dimensions and relative proportions of the first body portions, second body portions, flaps, etc. of the food containers or blanks will vary according to the exact size and intended use of the food containers or blanks. For purpose of illustration and not limitation, exemplary dimensions and angles shown in FIGS. 1, 4, and 8 are provided in Table 1. However, it will be apparent to those skilled in the art that various modifications and variations to the exemplary dimensions and angles can be made without departing from the spirit or scope of the disclosed subject matter. One of ordinary skill will recognize that any suitable shape and depth of food container and corresponding blank can be employed, and the disclosed subject matter is not limited to the sizes and shapes illustrated in FIGS. 1-12. Other suitable shapes include rectangles, triangles, cylinders, ovals, various polygons, etc., having any suitable dimensions.

In addition to the specific embodiments claimed below, the disclosed subject matter is also directed to other embodiments having any other possible combination of the dependent features claimed below and those disclosed above. As such, the particular features disclosed herein can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

TABLE 1

| Exemplary Dimensions | |
|---|---|
| Dimension | Length in Inches |
| L101 | 11.1 |
| L102 | $10\frac{1}{64}$ |
| L103 | $1\frac{7}{8}$ |
| L104 | $2\frac{7}{32}$ |
| L105 | $\frac{3}{4}$ |
| L106 | $4\frac{17}{32}$ |
| L107 | 5 |
| L108 | 2.8 |
| L109 | $\frac{3}{8}$ |
| L110 | 1.1 |
| L111 | $1\frac{53}{64}$ |
| w101 | $2\frac{29}{32}$ |
| w102 | $4\frac{15}{64}$ |
| w103 | 9.77 |
| L201 | 11.06 |
| L202 | $2\frac{3}{32}$ |
| L203 | $4\frac{15}{32}$ |
| L204 | $4\frac{61}{64}$ |
| L205 | $3\frac{3}{32}$ |
| L206 | 1 |
| L207 | $2\frac{1}{16}$ |
| w201 | 10 |
| w202 | 5.43 |
| w203 | $2\frac{31}{32}$ |
| L301 | 11.06 |
| L302 | $2\frac{3}{32}$ |
| L303 | $4\frac{15}{32}$ |
| L304 | $4\frac{61}{64}$ |
| L305 | $3\frac{3}{32}$ |
| w301 | 9.69 |
| w302 | 5.43 |
| w303 | $2\frac{31}{32}$ |
| Dimension | Radius of Curvature in Inches |
| R11 | $2\frac{19}{32}$ |
| R21 | 2.572 |
| R22 | $2\frac{3}{16}$ |
| R23 | 2.572 |
| R31 | 2.572 |
| R32 | $2\frac{3}{16}$ |
| R33 | 2.572 |
| Angle | Degrees |
| θ11 | 11 |
| θ21 | 11 |
| θ31 | 11 |

The invention claimed is:

1. A food container comprising:

a first body portion and a second body portion, the first and second body portions joined proximate opposing sides thereof to define an interior of the container and a mouth to the interior, one of the first body portion and the second body portion having an arcuate first upper edge defining a portion of the mouth and extending toward the interior of the container and the other of the first body portion and the second body portion having an arcuate second upper edge defining a portion of the mouth and extending away from the interior of the container, the container having a flat configuration with the first and second body portions in a generally planar condition and an expanded configuration with the first and second body portions in a contoured condition; and first side flaps extending from the opposing sides of the first body portion and folded inwardly into the interior of the container, at least one of the first side flaps having an engagement feature disposed thereon, the engagement feature of the at least one first side flap disposed to engage an opposing first side flap when the container is the expanded configuration to form an interior dividing wall within the interior of the container.

2. The food container of claim 1, wherein at least one of the first body portion and the second body portion has bend lines extending along at least a portion of a length thereof to provide the contoured condition of the at least one of the first body portion and the second body portion.

3. The food container of claim 1, wherein each first side flap is defined in part by a first side flap fold line along at least a portion of a respective side of the first body portion.

4. The food container of claim 3, wherein the at least one of the first side flaps has a free end opposite the first side flap fold line, the engagement feature configured as a tab extending from the free end, the container further having an opening defined therein to receive the tab when the container is in the expanded configuration.

5. The food container of claim 4, wherein the engagement feature further comprises a first interlocking hook disposed on the at least one of the first side flaps to engage a second interlocking hook disposed on the opposing first side flap when the container is in the expanded configuration to form the interior dividing wall.

6. The food container of claim 3, further comprising second side flaps extending from opposing sides of the second body portion, each second side flap defined in part by a second side flap fold line along at least a portion of a respective side of the second body portion, each second side flap folded inwardly into the interior of the container.

7. The food container of claim 6, wherein the at least one first side flap and one of the second side flaps each has a free end with an engagement feature configured as a tab extending from the free end, the tab of the at least one first side flap and the tab of the second side flap being disposed adjacent to and aligned with each other, the container further having an opening defined therein to receive the tab of the at least one first side flap and the tab of the second side flap when the container is in the expanded configuration.

8. The food container of claim 7, wherein the opening is defined by a gap between the first and second body portions.

9. The food container of claim 8, wherein the first side flaps are secured to the second side flaps to join the first and second body portions proximate the opposing sides thereof.

10. The food container of claim 9, wherein each first side flap is secured to a respective second side flap by an adhesive.

11. The food container of claim 6, wherein the engagement feature is configured as an aperture defined in one of the first side flaps and one of the second side flaps, the aperture of the first side flap and the aperture of the second side flap being disposed adjacent to and aligned with each other, and further wherein the other of the first side flaps and the other of the second side flaps are secured together at a discrete location disposed within the aperture of the first side flap and the aperture of the second side flap.

12. A unitary blank for forming a food container comprising:

a first body portion, a second body portion, and a base panel aligned along a longitudinal axis, the first body portion and the second body portion each having a base edge and opposing sides, the base edge of the first body portion facing the base edge of the second body portion with the base panel disposed therebetween, the base panel having a longitudinal base fold line extending substantially parallel with the base edge of the first body portion and the base edge of the second body portion, and a lateral fold line extending substantially perpendicular to the longitudinal base fold line; and first side flaps extending laterally from the opposing sides of the first body portion, each first side flap defined in part by a first side flap fold line along at least a portion of a respective side of the first body portion, at least one of the first side flaps having an engagement feature disposed thereon, the engagement feature disposed to engage an opposing first side flap when folded along the first side flap fold lines and moved toward each other, the first side flaps forming an interior dividing wall when the first and second body portions are joined proximate the opposing sides thereof to define a container having an interior.

13. The blank of claim 12, wherein the at least one of the first side flaps has a free end opposite the first side flap fold line, the engagement feature configured as a tab extending from the free end, the container formed from the blank further having an opening defined therein to receive the tab.

14. The blank of claim 13, wherein the engagement feature further comprises a first interlocking hook disposed on the at least one of the first side flaps to engage a second interlocking hook disposed on the opposing first side flap when the container is in the expanded configuration to form the interior dividing wall.

15. The blank of claim 12, further comprising second side flaps extending from opposing sides of the second body portion, each second side flap defined in part by a second side flap fold line along at least a portion of a respective side of the second body portion, each second side flap configured to be folded inwardly into the interior of the container.

16. The blank of claim 15, wherein the at least one of the first side flaps and one of the second side flaps each has a free end with an engagement feature configured as a tab extending from the free end, the tab of the at least one first side flap and the tab of the second side flap being disposed adjacent to and aligned with each other, the container formed from the blank further having an opening defined therein to receive the tab of the at least one first side flap and the tab of the second side flap.

17. The blank of claim 15, wherein the engagement feature is configured as an aperture defined in one of the first side flaps and one of the second side flaps, the aperture of the first side flap and the aperture of the second side flap being spaced apart a similar distance from a corresponding base edge and aligned with each other.

18. The blank of claim 12, wherein the base panel comprises arcuate fold lines on opposing sides of the lateral base fold line.

19. A food container comprising:

a first body portion and a second body portion, the first and second body portions joined proximate opposing sides thereof to define an interior of the container and a mouth to the interior, the container having a flat configuration with the first and second body portions in a generally planar condition and an expanded configuration with the first and second body portions in a contoured condition; and first side flaps extending from the opposing sides of the first body portion and folded inwardly into the interior of the container, each first side flap defined in part by a first side flap fold line along at least a portion of a respective side of the first body portion, and at least one of the first side flaps having an engagement feature disposed thereon including an aperture defined in the at least one first side flap, the engagement feature disposed to engage an opposing first side flap when the container is in the expanded condition to form an interior dividing wall within the interior of the container; and second side flaps extending from the opposing sides of the second body portion and folded inwardly into the interior of the container, each second side flap defined in part by a second side flap fold line along at least a portion of a respective side of the second body portion, and one of the second side flaps having an aperture defined therein, wherein the aperture of the at least one first side flap and the aperture of the one second side flap are disposed adjacent to and aligned with each other and the opposing first side flap and an opposing second side flap are secured together at a discrete location disposed within the aperture of the at least one first side flap and the aperture of the one second side flap.

20. The food container of claim 19, wherein the engagement feature further comprises a first interlocking hook disposed on the at least one of the first side flaps to engage a second interlocking hook disposed on the opposing first side flap when the container is in the expanded configuration to form the interior dividing wall.

21. The food container of claim 19, wherein the discrete location of each of the opposing first side flap and the opposing second side flap comprises a raised surface.

22. The food container of claim 21, wherein the opposing first side flap and the opposing second side flap are secured together by an adhesive applied to the raised surfaces.

23. The food container of claim 22, wherein the secured raised surfaces are disposed at one region of the aperture when the container is in the flat configuration and move toward another region of the aperture when the container is urged toward the expanded configuration.

24. The food container of claim 23, wherein when the container is in the expanded configuration, the secured raised surfaces engage the first and second side flaps proximate the another region of the aperture.

25. A unitary blank for forming a food container comprising:

a first body portion and a second body portion aligned along a longitudinal axis, the first body portion and the second body portion each having a base edge and opposing sides, the base edge of the first body portion facing the base edge of the second body portion; and first side flaps extending laterally from the opposing sides of the first body portion, each first side flap defined in part by a first side flap fold line along at least a portion of a respective side of the first body portion, at least one of the first side flaps having an engagement feature disposed thereon including an aperture defined in the at least one first side flap, the engagement feature disposed to engage an opposing first side flap when folded along the first side flap fold lines and moved toward each other, the first side flaps forming an interior dividing wall when the first and second body portions are joined proximate the opposing sides thereof to define a container having an interior; and second side flaps extending from opposing sides of the second body portion, each second side flap defined in part by a second side flap fold line along at least a portion of a respective side of the second body portion, each second side flap configured to be folded inwardly into the interior of the container, and one of the second side flaps having an aperture defined therein, the aperture of the one second side flap and the aperture of the at least one first side flap being spaced apart a similar distance from a corresponding base edge and aligned with each other.

26. The blank of claim 25, wherein the engagement feature further comprises a first interlocking hook disposed on the at least one of the first side flaps to engage a second interlocking hook disposed on the opposing first side flap when the container is in the expanded configuration to form the interior dividing wall.

27. A food container comprising:

a first body portion and a second body portion, the first and second body portions joined proximate opposing sides thereof to define an interior of the container and a mouth to the interior, each of the first and second body portions having a base edge and a foot extending beyond the base edge to define a support surface, and a base portion disposed between the base edge of the first body portion and the base edge of the second body portion, the container having a flat configuration with the first and second body portions in a generally planar condition and an expanded configuration with the first and second body portions in a contoured condition and the base portion in an upwardly arched condition extending toward the interior; and first side flaps extending from the opposing sides of the first body portion and folded inwardly into the interior of the container, at least one of the first side flaps having an engagement feature disposed thereon, the engagement feature of the at least one first side flap disposed to engage the opposing first side flap when the container is the expanded configuration to form an interior dividing wall within the interior of the container.

* * * * *